US009905920B2

(12) United States Patent
Lin et al.

(10) Patent No.: US 9,905,920 B2
(45) Date of Patent: Feb. 27, 2018

(54) SMART ELECTRIC METER

(71) Applicant: Wistron NeWeb Corp., Hsinchu (TW)

(72) Inventors: Chia-Hong Lin, Hsinchu (TW); Chang-Hsiu Huang, Hsinchu (TW); I-Shan Chen, Hsinchu (TW); Guo-Cheng Tsai, Hsinchu (TW); Chun-Chia Kuo, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 121 days.

(21) Appl. No.: 13/966,856

(22) Filed: Aug. 14, 2013

(65) Prior Publication Data

US 2014/0118202 A1 May 1, 2014

(30) Foreign Application Priority Data

Nov. 1, 2012 (TW) ..... 101140470 A

(51) Int. Cl.

| | |
|---|---|
| ***H01Q 3/04*** | (2006.01) |
| ***H01Q 3/02*** | (2006.01) |
| ***H01Q 1/12*** | (2006.01) |
| ***H01Q 1/22*** | (2006.01) |

(52) U.S. Cl.

CPC ..... *H01Q 3/04* (2013.01); *H01Q 1/125* (2013.01); *H01Q 1/2233* (2013.01); *H01Q 3/02* (2013.01)

(58) Field of Classification Search

CPC ..... H01Q 1/125; H01Q 1/22; H01Q 1/2233; H01Q 3/02; H01Q 3/04

See application file for complete search history.

(56) References Cited

U.S. PATENT DOCUMENTS

| | | | | |
|---|---|---|---|---|
| 8,228,209 | B2 | 7/2012 | Smith | |
| 2003/0085844 | A1* | 5/2003 | Olson et al. | 343/749 |
| 2005/0052328 | A1 | 3/2005 | De Angelis | |
| 2006/0284784 | A1* | 12/2006 | Smith et al. | 343/872 |
| 2012/0098710 | A1* | 4/2012 | Seal et al. | 343/702 |

* cited by examiner

*Primary Examiner* — Robert Karacsony

(74) *Attorney, Agent, or Firm* — Muncy, Geissler, Olds & Lowe, P.C.

(57) ABSTRACT

A smart electric meter is provided. The smart electric meter includes a body, an antenna holder, an antenna structure and a supporting member. The antenna holder is disposed on the body, wherein the antenna holder is annular. The antenna structure is disposed on the antenna holder, wherein the antenna structure is moveable along a circumferential direction of the antenna holder. The supporting member is connected to the antenna structure, wherein the supporting member is moveably disposed on the antenna holder, and the supporting member moves the antenna structure along the circumferential direction of the antenna holder.

16 Claims, 5 Drawing Sheets

SMART ELECTRIC METER

CROSS REFERENCE TO RELATED APPLICATIONS

This Application claims priority of Taiwan Patent Application No. 101140470, filed on Nov. 1, 2012, the entirety of which is incorporated by reference herein.

BACKGROUND OF THE INVENTION

Field of the Invention

The present invention relates to a smart electric meter, and in particular, relates to a smart electric meter with an antenna structure.

Description of the Related Art

Smart electric meters are often mounted near metal, such as an iron frame or iron box, wherein the metal may obstruct the signal transmission of the smart electric meters. When the distance between the smart electric meter and the metal is too small, obstruction occurs, thus changing the impedance matching of the antenna of the smart electric meter, and deteriorating signal transmission. If occurring, the smart electric meter must be remounted.

BRIEF SUMMARY OF THE INVENTION

A smart electric meter is provided. The smart electric meter includes a body, an antenna holder, an antenna structure and a supporting member. The antenna holder is disposed on the body, wherein the antenna holder is annular. The antenna structure is disposed on the antenna holder, wherein the antenna structure is moveable along a circumferential direction of the antenna holder. The supporting member is connected to the antenna structure, wherein the supporting member is moveably disposed on the antenna holder, and the supporting member moves the antenna structure along the circumferential direction of the antenna holder.

Utilizing the smart electric meter of the embodiment of the invention, the antenna structure is moveable along the circumferential direction of the antenna holder to modify the orientation of the antenna structure. Therefore, the smart electric meter can be conveniently settled according to the surrounding environment, avoid the interference of the existed metal obstructor (for example, iron frame or iron box), and provide qualified wireless transmission.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
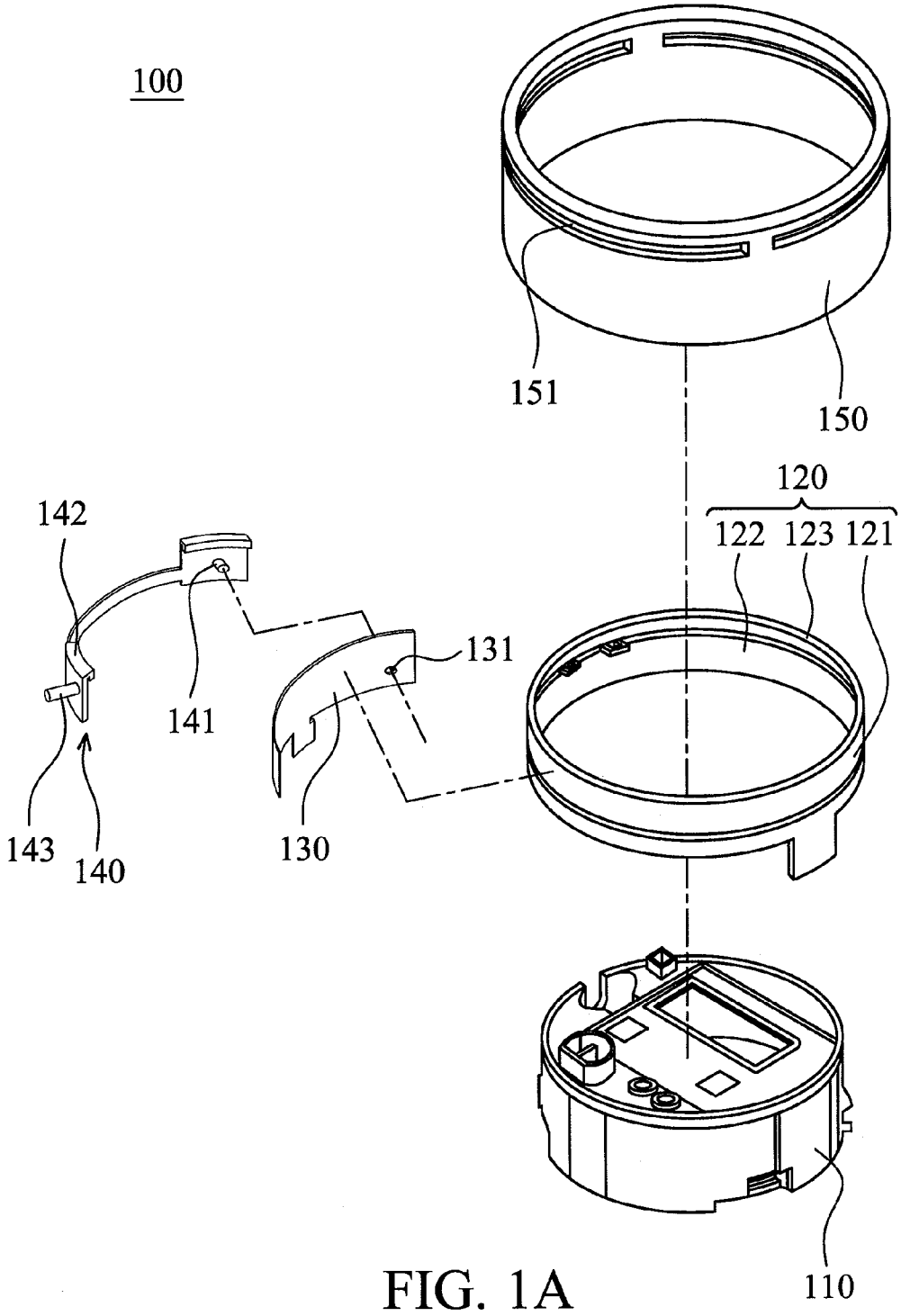
FIG. 1A is the exploded view of the smart electric meter of the first embodiment of the invention.
Figure 1B:
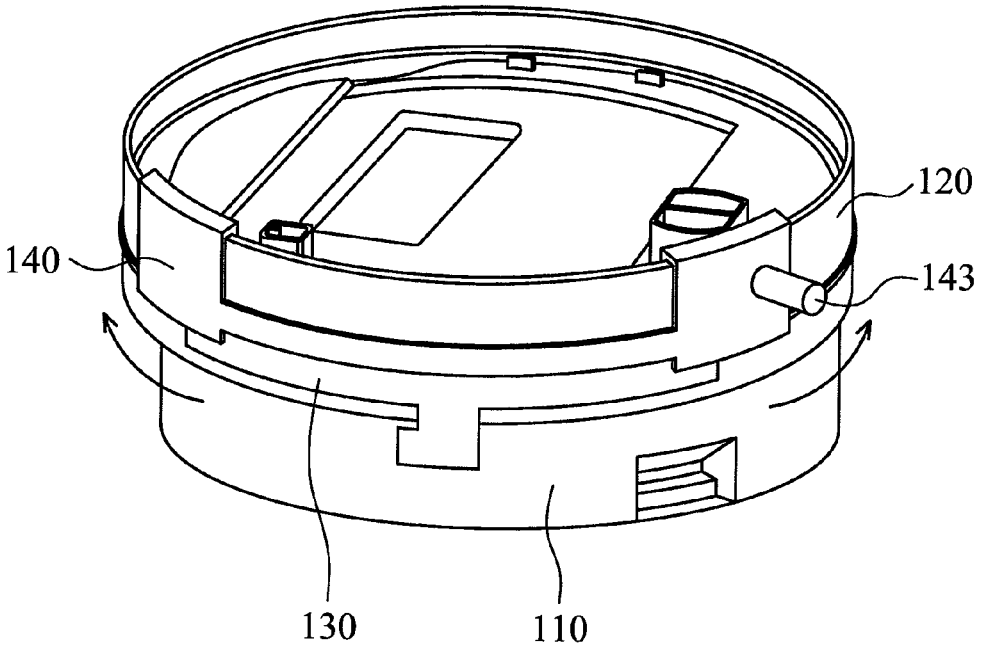
FIG. 1B is the perspective view of the smart electric meter of the first embodiment of the invention, wherein the cover is omitted.

FIG. 1A is an exploded view of a smart electric meter of a first embodiment of the invention. The smart electric meter 100 of the first embodiment of the invention comprises a body 110, an antenna holder 120, an antenna structure 130, a supporting member 140 and a cover 150. FIG. 1B is a perspective view of the smart electric meter of the first embodiment of the invention, wherein the cover 150 is omitted for clear illustration. With reference to FIGS. 1A and 1B, the antenna holder 120 is disposed on the body, wherein the antenna holder 120 is annular. The antenna structure 130 is disposed on the antenna holder 120, wherein the antenna structure 130 is moveable along a circumferential direction of the antenna holder 120. The supporting member 140 is connected to the antenna structure 130, wherein the supporting member 140 is moveably disposed on the antenna holder 120, and the supporting member 140 moves the antenna structure 130 along the circumferential direction of the antenna holder 120.

Figure 2A:
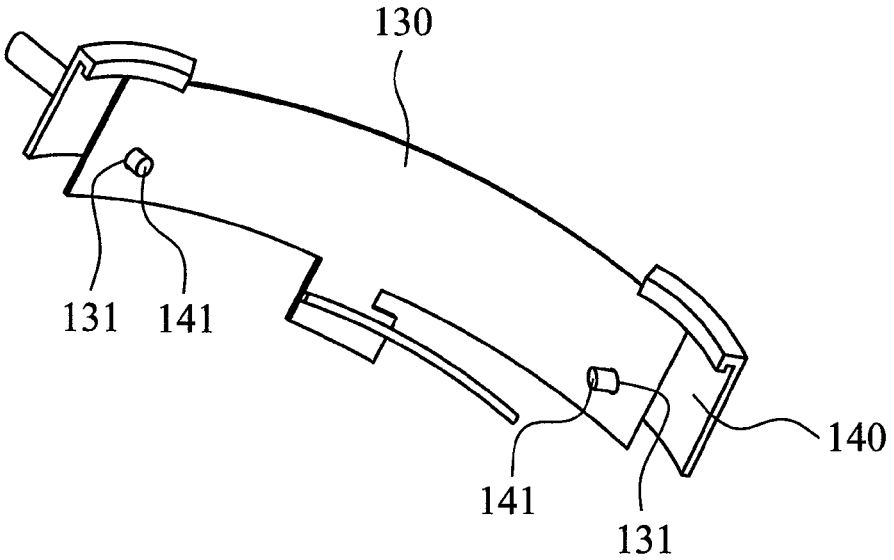
FIG. 2A shows the supporting member being assembled with the antenna structure.

FIG. 2A shows the supporting member 140 being assembled with the antenna structure 130. The supporting member 140 comprises a positioning post 141. A positioning hole 131 is formed on the antenna structure 130. The positioning post 141 passes through the positioning hole 131 to connect the supporting member 140 to the antenna structure 130.

With reference to FIG. 1A, the antenna holder comprises a first surface (outer surface) 121, a second surface (inner surface) 122 and a first edge (upper edge) 123. The first surface 121 is opposite to the second surface 122. The first edge 123 is located between the first surface 121 and the second surface 122. The antenna structure 130 is sandwiched between the first surface 121 and the supporting member 140.

Figure 2B:
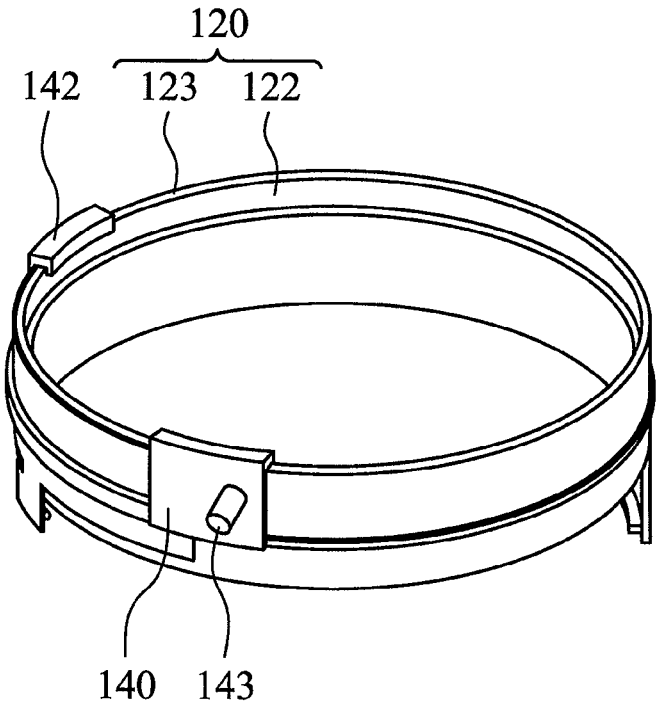
FIG. 2B shows the supporting member hung on the antenna holder.

With reference to FIG. 2B, the supporting member 140 further comprises a hook 142, and the hook 142 abuts the first edge 123 and the second surface 122 hang the supporting member 140 on the antenna holder 120.

With reference to FIGS. 1A and 1B, the supporting member 140 further comprises a rod 143. An extending direction of the rod 143 is opposite to an extending direction of the post 141. When the rod 143 is pushed, the supporting member 140 pushes the antenna structure 130 to slide along a peripheral direction of the antenna holder 120. The cover 150 covers the antenna holder 120, the antenna structure 130 and the supporting member 140. The cover 150 comprises a groove 151. The rod 143 passes through the groove 151 and is projected over an outer surface of the cover 150, which allows a user to push the rod 143.

Utilizing the smart electric meter of the embodiment of the invention, the antenna structure is moveable along the circumferential direction of the antenna holder to modify the orientation of the antenna structure. Therefore, the smart electric meter can be conveniently settled according to the surrounding environment, avoid the interference of the existed metal obstructor (for example, iron frame or iron box), and provide qualified wireless transmission.

Figure 3:
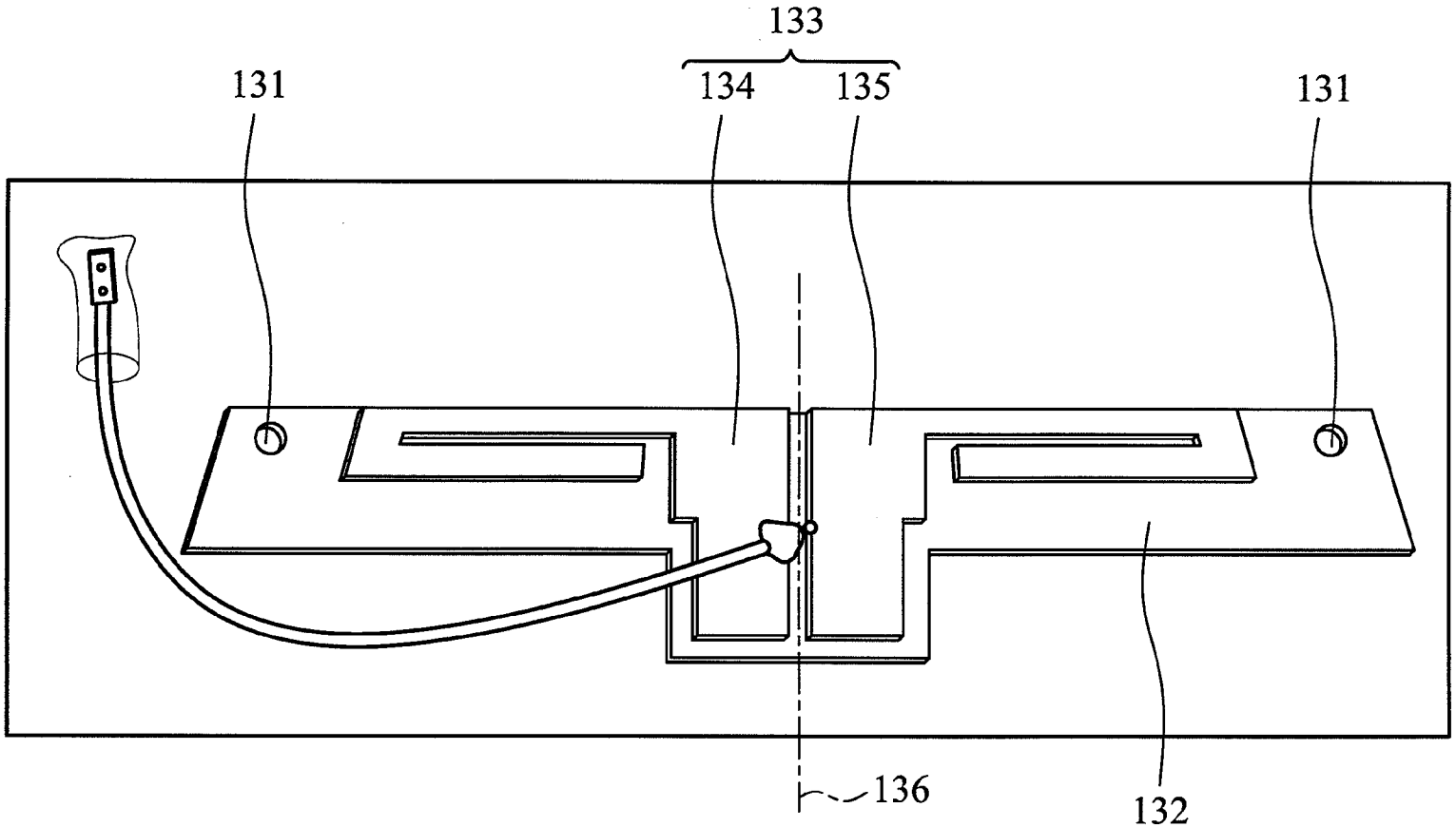
FIG. 3 shows the embodiment of the antenna structure of the invention.

FIG. 3 shows an embodiment of the antenna structure 130 of the invention. The antenna structure 130 comprises a flexible substrate 132 and a dipole antenna 133. The dipole antenna 133 is formed on the flexible substrate 132. The dipole antenna 133 comprises a first radiator 134 and a second radiator 135, and the first radiator 134 is symmetrical to the second radiator 135 and relative to a central line 136. In the embodiment of the invention, the antenna structure can be a dipole antenna or other antenna, and the disclosure above does not restrict the invention.

Figure 4:
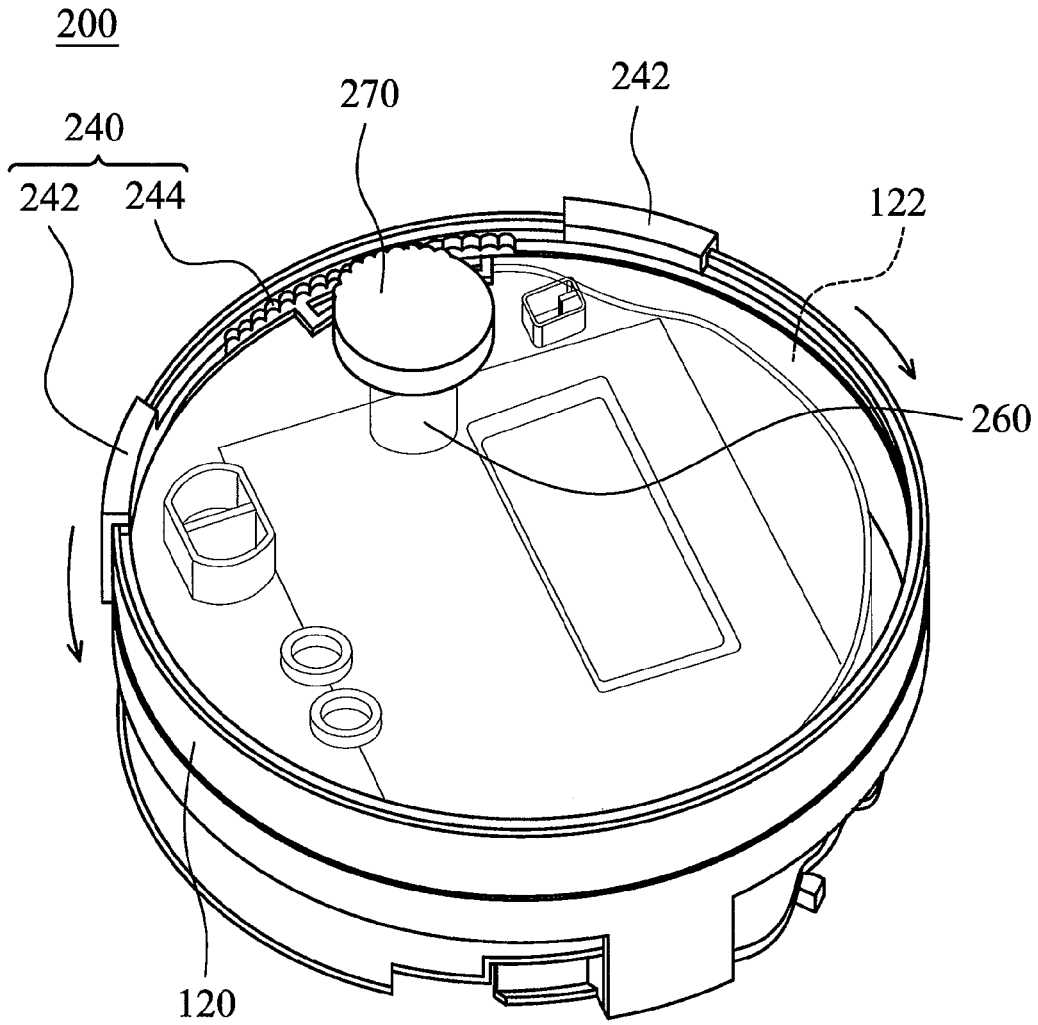
FIG. 4 shows the smart electric meter of the second embodiment of the invention.

FIG. 4 shows a smart electric meter 200 of a second embodiment of the invention. In the second embodiment, manual movement is replaced by an automatic mechanism to modify the orientation of the antenna structure. With reference to FIG. 4, the smart electric meter 200 of the second embodiment of the invention comprises an actuator 260 and a transmission mechanism 270, and the actuator 260 is connected to the transmission mechanism 270. The transmission mechanism 270 is connected to the antenna holder 120. The actuator 260 actuates the transmission mechanism 270 to move the supporting member 240 to slide along the peripheral direction of the antenna holder 120. The transmission mechanism 270 is a gear wheel or other structure. The supporting member 240 comprises a rack 244. The transmission mechanism (gear wheel) 270 is engaged with the rack 244. When the transmission mechanism 270 is rotated, the supporting member 240 is moved by the transmission mechanism 270 and slides along the peripheral direction of the antenna holder 120.

The actuator 260 can be an electric motor or other actuators.

In this embodiment, the rack 244 is formed between two hooks 242. The rack corresponds to the second surface 122, and the antenna holder 120 surrounds the actuator 260 and the transmission mechanism 270.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A smart electric meter, comprising:

a body of the smart electric meter;

an antenna holder, disposed on the body, wherein the antenna holder is annular;

an antenna structure, disposed on the antenna holder, wherein the antenna structure is moveable along a circumferential direction of the antenna holder; and a supporting member, connected to the antenna structure, wherein the supporting member is moveably disposed on the antenna holder, and the supporting member moves the antenna structure along the circumferential direction of the antenna holder, wherein the supporting member comprises a positioning post, a positioning hole is formed on the antenna structure, and the positioning post passes through the positioning hole to connect the supporting member to the antenna structure.

2. The smart electric meter as claimed in claim 1, wherein the antenna holder comprises a first surface, and the antenna structure is sandwiched between the first surface and the supporting member.

3. The smart electric meter as claimed in claim 2, wherein the antenna holder further comprises a second surface and a first edge, and the first surface is opposite to the second surface, the first edge is located between the first surface and the second surface, the supporting member further comprises a hook, and the hook abuts the first edge and the second surface to hang the supporting member on the antenna holder.

4. The smart electric meter as claimed in claim 3, wherein the first surface is an outer surface of the antenna holder, and the second surface is an inner surface of the antenna holder.

5. The smart electric meter as claimed in claim 1, wherein the supporting member further comprises a rod, and an extending direction of the rod is opposite to an extending direction of the post, and when the rod is pushed, the supporting member pushes the antenna structure to slide along a peripheral direction of the antenna holder.

6. The smart electric meter as claimed in claim 5, further comprising a cover, wherein the cover covers the antenna holder, the antenna structure and the supporting member, and the cover comprises a groove, and the rod passes through the groove and is projected over an outer surface of the cover.

7. The smart electric meter as claimed in claim 1, wherein the antenna structure comprises a flexible substrate and a dipole antenna, and the dipole antenna is formed on the flexible substrate.

8. The smart electric meter as claimed in claim 7, wherein the dipole antenna comprises a first radiator and a second radiator, and the first radiator is symmetrical to the second radiator and relative to a central line.

9. A smart electric meter, comprising:

a body of the smart electric meter;

an antenna holder, disposed on the body, wherein the antenna holder is annular;

an antenna structure, disposed on the antenna holder, wherein the antenna structure is moveable along a circumferential direction of the antenna holder;

a supporting member, connected to the antenna structure, wherein the supporting member is moveably disposed on the antenna holder, and the supporting member moves the antenna structure along the circumferential direction of the antenna holder; and an actuator and a transmission mechanism, wherein the actuator is connected to the transmission mechanism, and the transmission mechanism is connected to the antenna holder, and the actuator actuates the transmission mechanism to move the supporting member to slide along a peripheral direction of the antenna holder.

10. The smart electric meter as claimed in claim 9, wherein the transmission mechanism is a gear wheel, and the supporting member comprises a rack, and the gear wheel is engaged with the rack, and when the transmission mechanism is rotated, the supporting member is moved by the transmission mechanism and slid along the peripheral direction of the antenna holder.

11. The smart electric meter as claimed in claim 10, wherein the antenna holder further comprises a first surface, a second surface and a first edge, and the first surface is opposite to the second surface, the first edge is located between the first surface and the second surface, and the antenna structure is sandwiched between the first surface and the supporting member.

12. The smart electric meter as claimed in claim 11, wherein the rack corresponds to the second surface, and the antenna holder surrounds the actuator and the transmission mechanism.

13. The smart electric meter as claimed in claim 11, wherein the supporting member further comprises a hook, and the hook abuts the first edge and the second surface to hang the supporting member on the antenna holder, wherein the rack is connected to the hook.

14. The smart electric meter as claimed in claim 13, wherein the first surface is an outer surface of the antenna holder, and the second surface is an inner surface of the antenna holder.

15. The smart electric meter as claimed in claim 9, wherein the antenna structure comprises a flexible substrate and a dipole antenna, and the dipole antenna is formed on the flexible substrate.

16. The smart electric meter as claimed in claim 15, wherein the dipole antenna comprises a first radiator and a second radiator, and the first radiator is symmetrical to the second radiator and relative to a central line.

* * * * *